US007707763B2

(12) United States Patent
Brixius

(10) Patent No.: US 7,707,763 B2
(45) Date of Patent: May 4, 2010

(54) GUN BARREL ASSEMBLY

(76) Inventor: John Brixius, 29 Deerfield Ave., Eastchester, NY (US) 10709

( * ) Notice: Subject to any disclaimer, the term of this patent is extended or adjusted under 35 U.S.C. 154(b) by 442 days.

(21) Appl. No.: 11/888,778

(22) Filed: Aug. 2, 2007

(65) Prior Publication Data

US 2010/0058921 A1 Mar. 11, 2010

Related U.S. Application Data

(63) Continuation of application No. 11/039,747, filed on Jan. 19, 2005, now Pat. No. 7,353,741.

(60) Provisional application No. 60/538,070, filed on Jan. 20, 2004.

(51) Int. Cl.
*F41C 27/00* (2006.01)

(52) U.S. Cl. ..... 42/90; 89/14.1; 89/14.3; 42/76.01

(58) Field of Classification Search ..... 89/14.05–14.4; 42/76.01, 77, 79, 90
See application file for complete search history.

(56) References Cited

U.S. PATENT DOCUMENTS

| | | | | | |
|---|---|---|---|---|---|
| 621,085 | A | | 3/1899 | Hookham | |
| 1,004,665 | A | | 10/1911 | Lewis | |
| 1,004,666 | A | | 10/1911 | Lewis | |
| 1,227,897 | A | | 5/1917 | Dunwoody | |
| 1,351,017 | A | * | 8/1920 | Blackmore | 89/126 |
| 1,406,404 | A | | 2/1922 | McCrudden | |
| 1,789,835 | A | * | 1/1931 | Pedersen | 89/14.1 |
| 2,287,066 | A | * | 6/1942 | Rogers | 89/14.05 |
| 2,337,840 | A | | 12/1943 | Scott-Paine et al. | |
| 2,364,944 | A | | 12/1944 | Brown | |
| 2,447,205 | A | * | 8/1948 | Powell | 42/79 |
| 2,467,372 | A | * | 4/1949 | De Permentier | 89/14.1 |
| 2,712,193 | A | | 7/1955 | Mathis | |
| 2,872,848 | A | | 2/1959 | Schuessler | |
| 3,707,899 | A | | 1/1973 | Perrine | |
| 4,058,050 | A | | 11/1977 | Brouthers | |
| 4,207,799 | A | | 6/1980 | Tocco | |
| 4,279,091 | A | | 7/1981 | Edwards | |
| 4,392,413 | A | | 7/1983 | Gwinn, Jr. | |
| 4,397,217 | A | | 8/1983 | Hupp | |
| 4,439,943 | A | | 4/1984 | Brakhage | |
| 4,459,895 | A | | 7/1984 | Mazzanti | |
| 4,534,264 | A | | 8/1985 | Tarnoff et al. | |

(Continued)

OTHER PUBLICATIONS

Gourley, Scott, "Weapons of the Special Forces", Popular Mechanics, Sep. 2004, pp. 81-90.

*Primary Examiner*—Michael Carone
*Assistant Examiner*—Gabriel J Klein
(74) *Attorney, Agent, or Firm*—RatnerPrestia

(57) ABSTRACT

A firearm barrel assembly having a gun barrel with a muzzle opening on a distal end, a shroud coaxially surrounding at least a portion of the barrel, the shroud having a distal portion extending beyond the muzzle opening defining a shroud front region having a distal end portion, a proximal portion extending proximally from the muzzle opening defining an annular region between the barrel and shroud, the shroud front region and annular region in fluid communication with substantially no obstruction between the shroud front region and the annular region, and a front wall disposed at the distal end portion of the shroud. The wall has an opening to allow passage of a projectile fired from the firearm.

7 Claims, 8 Drawing Sheets

U.S. PATENT DOCUMENTS 4,545,285 A 10/1985 McLain
4,583,445 A 4/1986 Blair
4,641,451 A 2/1987 Harris
4,664,014 A 5/1987 Hawley et al.
4,691,614 A 9/1987 Leffel et al.
4,833,808 A 5/1989 Strahan
4,852,460 A 8/1989 Davidson
4,869,151 A 9/1989 Chahin
4,907,488 A 3/1990 Seberger
4,930,397 A 6/1990 Seidler
5,036,747 A 8/1991 McClain, III
5,123,329 A * 6/1992 Irwin ..... 89/161
5,225,615 A 7/1993 Talbot et al.
5,305,678 A 4/1994 Talbot et al.
5,320,022 A 6/1994 Kimbro et al.
5,333,529 A 8/1994 Brockman
5,353,681 A * 10/1994 Sugg ..... 89/43.01
5,355,765 A 10/1994 Rogers
5,357,842 A 10/1994 Reynolds
5,367,940 A 11/1994 Taylor
5,463,930 A 11/1995 Bisping et al.
5,476,028 A 12/1995 Seberger
5,631,438 A 5/1997 Martel
5,753,846 A 5/1998 Koon
5,798,474 A 8/1998 Rogers et al.
5,811,714 A 9/1998 Hull et al.
5,814,757 A 9/1998 Buss
6,079,311 A 6/2000 O'Quinn et al.
6,269,727 B1 8/2001 Nigge
6,276,251 B1 * 8/2001 Downing et al. ..... 89/14.3
6,302,009 B1 10/2001 O'Quinn et al.
6,490,959 B2 12/2002 Lavin
6,508,159 B1 1/2003 Muirhead
2003/0154849 A1 8/2003 Breuer

* cited by examiner

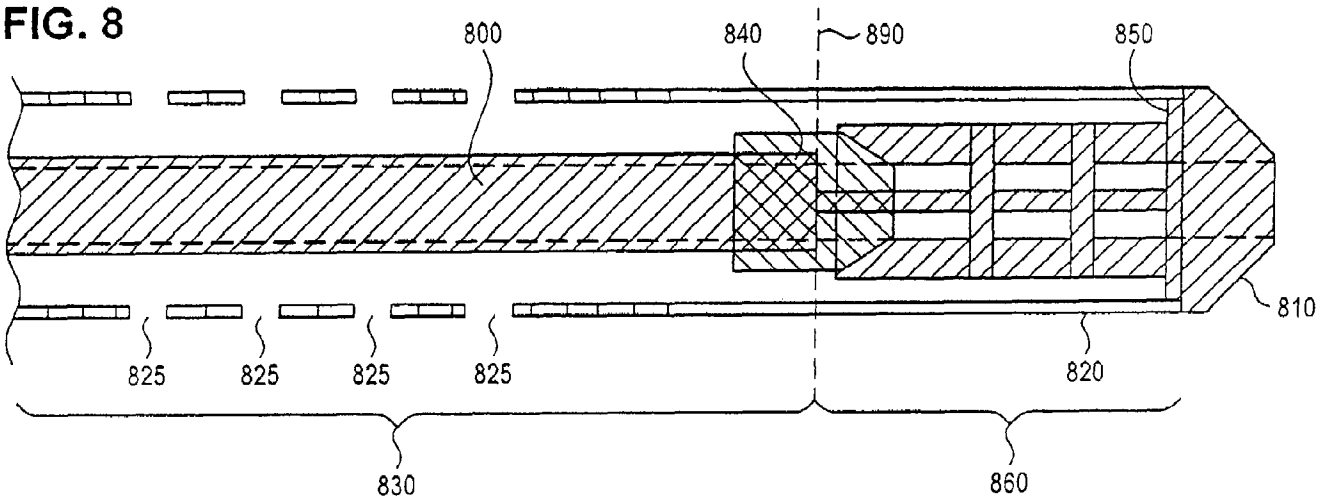
FIG. 8
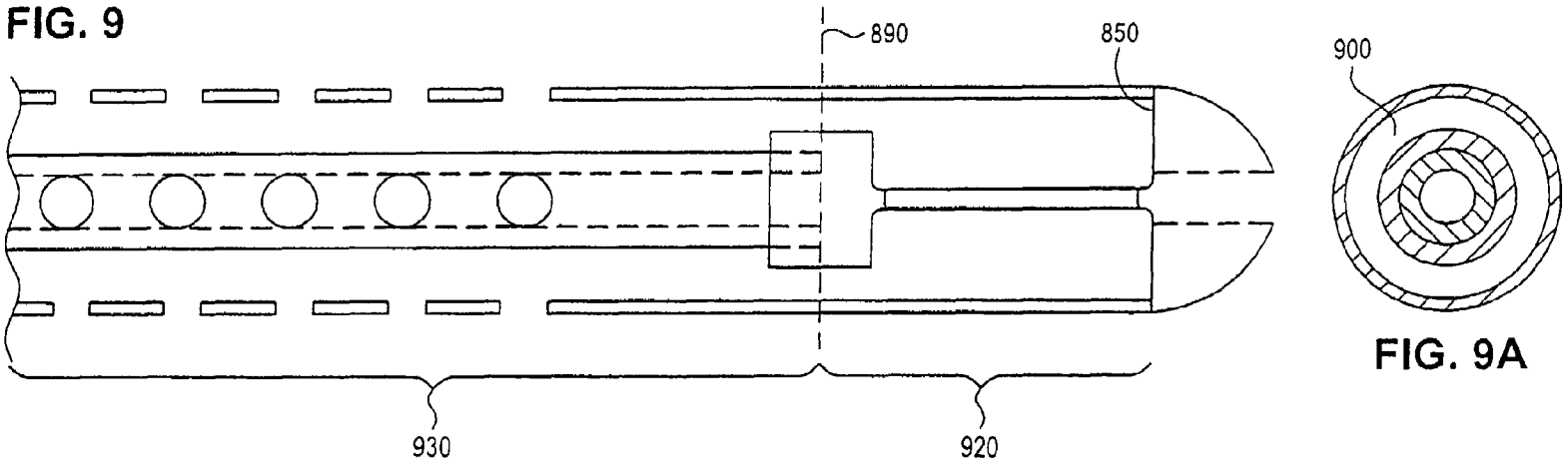
FIG. 9A
FIG. 9

GUN BARREL ASSEMBLY

CROSS REFERENCE TO RELATED APPLICATIONS

This application is a Continuation of U.S. patent application Ser. No. 11/039,747, filed Jan. 19, 2005 now U.S. Pat. No. 7,353,741, which claims the benefit of earlier filed U.S. Provisional Application Ser. No. 60/538,070 filed Jan. 20, 2004; the entire disclosure of which is incorporated by reference herein.

FIELD OF INVENTION

The present invention relates to firearms, and more specifically to firearm barrels and barrel assemblies, and how their design affects the performance of the firearm.

BACKGROUND OF INVENTION

Since the 13$^{th}$ century, firearms have operated on the principle that an explosive mass of powder, generally referred to as gun powder, could be ignited and caused to react and "explode" causing a sudden increase in pressure within a confined and defined space. This constant volume pressure increase was caused to happen behind a projectile, which was then forced in the one direction it could move, along with the exploding gas, which was down a barrel and out the end of a firearm muzzle. Early firearms were loaded down the muzzle, by first inserting a charge of gunpowder, and then on top of that powder adding a projectile, which was typically a lead ball, and pushing the ball down the muzzle with a ram-rod to seat the ball atop the powder charge. These, of course, were known as muzzleloaders.

As firearm technology progressed, primarily in the United States during the 1850's and 1860's, it became possible to load a charge of powder into a casing, or shell, and seat the projectile in a friction fit at the open end of the casing. This discovery lead to the development of a whole new era in firearm development. Christopher Spencer received patent protection on Mar. 6, 1860 (U.S. Pat. No. 27,393) for what became known as the Spencer Repeating Rifle, Tyler Henry received a patent for the Henry Rifle on Oct. 16, 1860 (U.S. Pat. No. 30,446), and Horace Smith and Daniel Wesson eventually formed Smith & Wesson to manufacture some of the first revolvers using these new cartridges, and thereby continued firearm development which led to the issuance of numerous patents for innovation during this time period. Of course, Colt's Patent Manufacturing Company received a large number of patents over the years, perhaps most notably for its Colt's Single Action Army Revolver which utilized these new cartridges in what is now a famous revolving cylinder repeater.

All of these developments in firearm and cartridge technology paved the path from muzzleloaders to the modern cartridge, which, even today, is typically comprised of a metal casing (originally copper and now often brass), with a primer lodged in one end and the bullet (projectile) lodged in the other. Contained within the casing is the gunpowder. The primer does not come out of the casing during the firing of the cartridge. The cartridge is loaded into a modern firearm in a number of different ways depending upon the particular action of the firearm used. The common link between the many modern actions, however, is that they are loaded at their breech, instead of down the muzzle as was traditionally done.

In these more modern firearms, when the firing pin of the firearm strikes the cartridge's primer, the primer ignites the powder within the shell, causing an extremely rapid pressure increase, which causes the projectile to dislodge from the shell's open end, driving the projectile down the barrel of the firearm and out the end of the muzzle toward its target. The explosion is an extremely fast exothermic chemical reaction that occurs in a constant volume as the contents of the gunpowder react. This constant volume expansion causes both a pressure increase and a concomitant temperature increase within the system. It is the large and extremely rapid pressure increase during the chemical reaction of the powder that generates the force necessary to drive the projectile at a high speed down the barrel.

Many modern loads have been developed to generate bullet energies over 3,000 ft-lbs at the muzzle and bullet velocities over 3000 ft/sec at the muzzle. For example, a typical 150 grain 0.30-06 bullet will have a muzzle velocity of about 2900 ft/sec and hold nearly 2900 ft-lbs. of energy at the muzzle. This level of energy requires powders and loads that generate great temperatures and pressures within the barrel. As the high temperature gases follow the bullet down the bore of the barrel, the temperature of the barrel raises significantly. This is especially profound when rapid-fire rifles are involved because the barrel does not have time to cool between shots.

One problem resulting from this combination of high pressure and temperature is an increase in the wear of the barrel, and as a result, reduced barrel life. Because pressure is greatest at the breach end (gas volume increases linearly while the physical volume increases exponentially and pressure is equal to gas volume divided by physical volume), the deterioration occurs more rapidly at the breach end of the barrel. This problem is exacerbated with higher pressure cartridges. Thus, heat dissipation is most beneficial to barrel life in the breach end of the barrel.

Also a problem is the high recoil of the high-pressure, heavy bullet systems common today. Recoil is essentially defined as what the shooter experiences as he holds the firearm, often to his shoulder, and always at least in his hand or hands, as the firearm discharges. For every action, there is an equal and opposite reaction. If a 200 grain bullet leaves a muzzle with over 3000 ft-lbs of energy, that momentum is also applied through the firearm to the shooter holding the firearm. These great recoils are not only sometimes uncomfortable or even damaging to the shooter, but greatly affect accuracy, target reacquisition, and sight realignment between shots.

Still another problem with these modern loads, particularly in tactical situations, is with respect to muzzle flash and report. Muzzle flash and report are essentially visual and audible indications, respectively, of the location of a shooter. By reducing either or both, the exact location of a shooter is less likely to be determined by those around him. Muzzle flash occurs when still-burning powder escapes the muzzle behind the bullet as the bullet exits the muzzle. As it exits and continues to burn (react) the fire or flash indicated can give away shooter location, especially at night or low light conditions. The problems with sound are, of course, obvious. One that merits detailing is that the greater the muzzle report, the more likely the shooter, or shooters near to the shooter, will flinch in anticipation of the loud, harmful sound, causing a decrease in the marksmanship of the shooter.

Some developments have occurred to attempt to remedy some of the above-described problems. Baffle muzzle breaks, for example, work on the principle of redirecting gases that would otherwise exit the muzzle in the direction of the projectile. In such cases, their performance is proportional to the percentage of gas they deflect. Many such muzzle breaks redirect expanding gases in a direction perpendicular to the longitudinal axis of the bore of the firearm, or in an angled, rearward direction at an acute angle with respect to the longitudinal axis of the bore of the firearm. In such cases, noise and debris is directed toward the shooter's face. Problems with this scenario are also obvious, not the least of which is increased potential for damage to the shooter's, or nearby person's, eardrums, and pronounced shooter's flinch resulting in a further degradation of marksmanship.

SUMMARY OF INVENTION

The present invention provides a gun barrel assembly comprising a gun barrel having a muzzle opening on a distal end, a shroud coaxially surrounding at least a portion of the barrel, the shroud having a distal portion extending beyond the muzzle opening defining a shroud front region having a distal end portion, a proximal portion extending proximally from the muzzle opening defining an annular region between the barrel and shroud, the shroud front region and annular region in fluid communication with substantially no obstruction between the shroud front region and the annular region, and a front wall disposed at the distal end portion of the shroud, the wall having an opening to allow passage of a bullet fired from the firearm.

Included also as a part of the invention is a gun barrel assembly comprising a gun barrel having a muzzle opening on a distal end, a shroud coaxially surrounding at least a portion of the barrel, the shroud having a distal portion extending beyond the muzzle opening defining a shroud front region having a distal end portion, a proximal portion extending proximally from the muzzle opening defining an annular region between the barrel and shroud, the shroud front region and annular region in fluid communication with substantially no obstruction between the shroud front region and the annular region, and circumferential holes in the proximal portion of the shroud and a muzzle cap extending from the muzzle opening to the distal end portion of the shroud front region, the muzzle cap having an opening to allow passage of a bullet fired from the firearm.

BRIEF DESCRIPTION OF THE FIGURES

The features of the invention believed to be novel and the elements characteristic of the invention are set forth with particularity in the appended claims. The figures are for illustration purposes only and are not necessarily drawn to scale. The invention itself, however, both as to organization and method of operation, may best be understood by reference to the detailed description which follows taken in conjunction with the accompanying drawings in which:

FIG. 8 is a partial cross sectional view of an exemplary embodiment of the present invention;

FIG. 9 is a partial cross sectional view of an exemplary embodiment of the present invention;

FIG. 9A is a cross sectional view of the embodiment shown in FIG. 9 taken at line 890;

DETAILED DESCRIPTION OF THE INVENTION

The present invention includes several features to improve firearm performance. It includes a barrel assembly and shroud which reduces felt recoil, reduces sound and muzzle flash, and has other features which combine to yield a firearm with substantially improved performance as compared to firearm systems of the prior art. In addition, preferred embodiments improve cooling, increase stiffness, and decrease the overall weight of the barrel unit.

Unless otherwise noted herein, the terms "distal" and "forward" and "front" all refer to a relative position away from a shooter in the direction of a projectile being fired, and the terms "proximal" and "rearward" and "rear" all refer to a relative position closer to the shooter with respect to the direction of a projectile being fired.

This invention is directed to a gun barrel assembly for firearms capable of shooting both "bullets" within their traditional meaning, as well as other projectiles which may not conventionally be considered "bullets" (such as explosive projectiles). For purposes of this disclosure, the terms "bullet" and "projectile" are considered interchangeable.

Figure 1A:
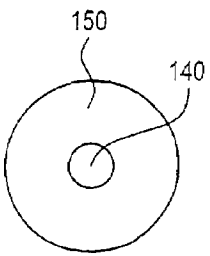
FIG. 1A is an end view looking rearward at the embodiment shown in FIG. 1.
Figure 1:
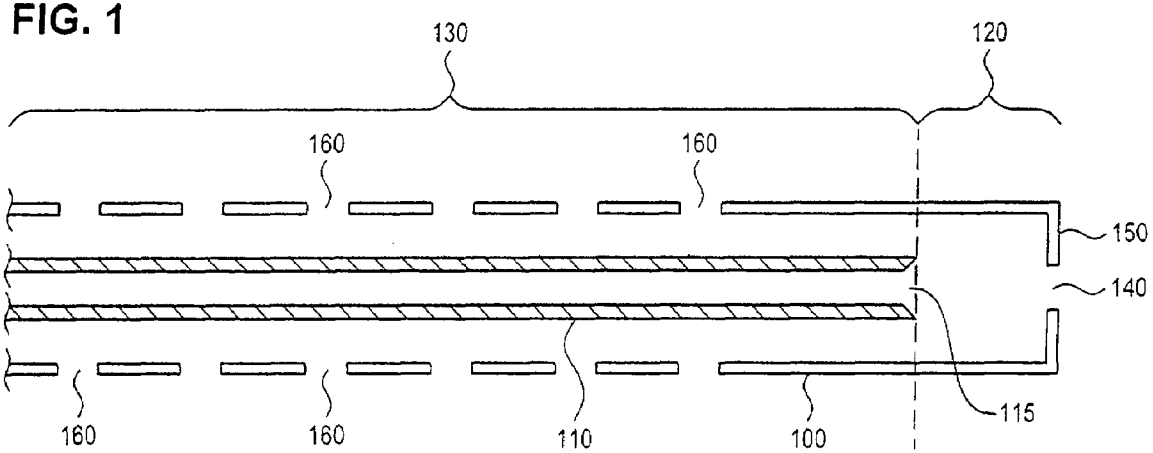
FIG. 1 is a partial cross sectional view of a barrel and shroud in accordance with the present invention.

One feature of the present invention is shown in FIG. 1. FIG. 1 illustrates a cross section of shroud 100 disposed around barrel 110. Shroud 100 is one piece in this embodiment, but can be viewed as having two regions, namely a shroud front region 120 which extends beyond the muzzle opening 115 of barrel 110, and a rearward, or proximal, region 130 which extends proximally, toward the shooter, from muzzle opening 115. Proximal region 130 defines an annular region between the shroud and barrel 110.

As part of front region 120, hole 140 is formed in front wall 150 to allow passage of a bullet fired from the firearm. Hole 140 may be larger than the bore diameter of barrel 110, but preferably is substantially the same size (although obviously it cannot be smaller). FIG. 1A shows an end view of the barrel assembly, with wall 150 and hole 140 noted. The significance of wall 150 will be discussed in detail below.

Also shown in FIG. 1 are circumferential holes 160 disposed in the wall of shroud 100. As shown in FIG. 1, however, circumferential holes 160 are only disposed in shroud 100 in proximal region 130. Generally, no holes (with the exception of front wall 150 hole 140) are disposed in front region 120.

An exception to this would be a very small water drain hole or holes in front region 120. Any such hole or holes would be just large enough to allow water to drain from the front portion of the shroud, but small enough that minimal gas escapes and instead travels rearward in accordance with the invention as herein described. Circumferential holes 160 are preferably disposed in the wall of shroud 100 such that their central axes are perpendicular to the longitudinal central axis of barrel 110. The significance of circumferential holes 160 will be discussed in detail below.

Figure 2:
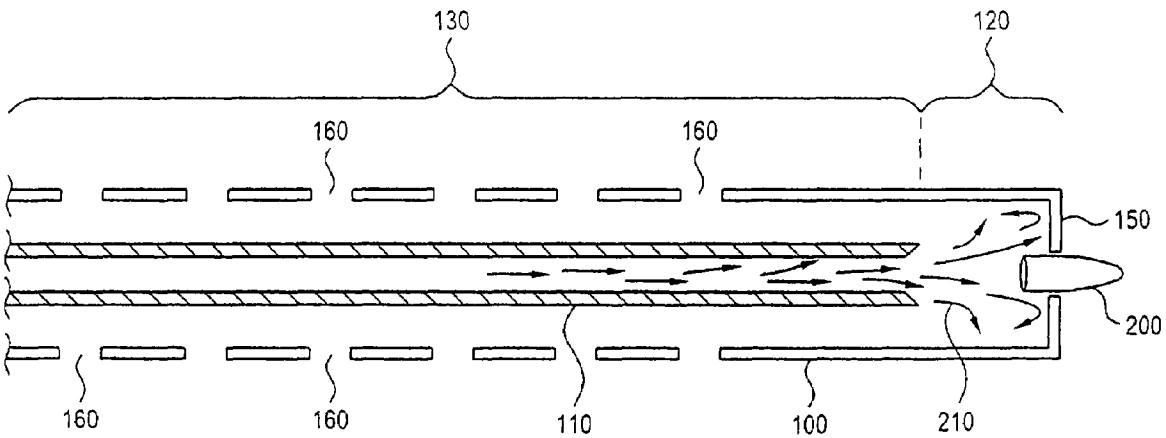
FIG. 2 is an illustration of the embodiment shown in FIG. 1 with a bullet passing through an opening.
Figure 3:
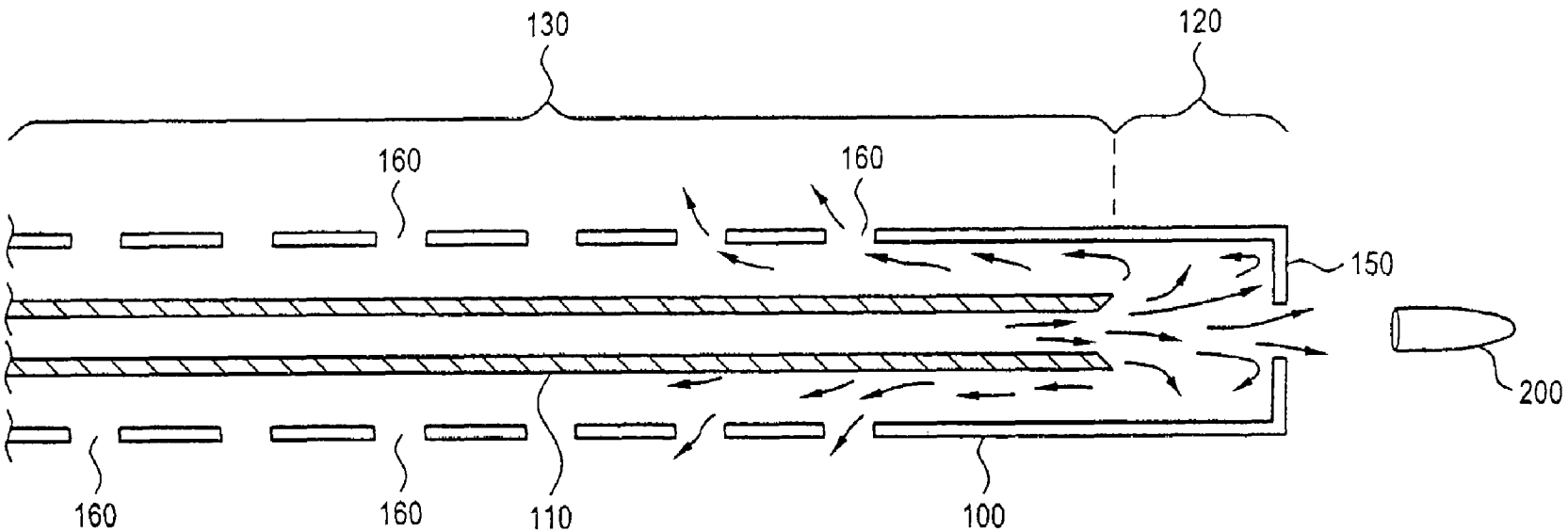
FIG. 3 is an illustration of the bullet from FIG. 2 after it has exited the assembly.

FIG. 2 shows the assembly of FIG. 1 but with a projectile, namely bullet 200, passing through shroud 100's front wall 150 through hole 140. Shown schematically as arrows 210 are the gases which are traveling behind bullet 200. As can be seen, as gases propel bullet 200 down the muzzle and through hole 140, they are deflected against the inside of front wall 150. This occurrence is particularly profound as bullet 200 is passing through hole 140, as shown in FIG. 2. It is worth noting that because the gases travel much faster than the bullet, during the time the rear of the bullet leaves the muzzle to the time that the rear of the bullet passes completely through hole 140, much of the gases exit the muzzle and travel as shown by arrows 210 and are deflected rearward before the bullet fully leaves the shroud. Also, because bullet 200 almost seals shroud front region 120 as it passes through hole 140, the gases propelling bullet 200 forward fill front region 120, pressurizing it, and then decompress in a rearward direction into shroud proximal region 130. As a result, bullet 200 leaves the shroud, as shown in FIG. 3, some gas escapes the shroud behind the bullet, but most still is caught at the inside of front wall 150 and is forced proximally as the remainder of expanding gas leaves the barrel muzzle opening. Several advantages are realized by this occurrence.

First, by having the escaping gases hitting the inside of front wall 150, the barrel's muzzle (and more specifically the firearm's distal end) is actually pushed away from the shooter. This has the result of reducing felt recoil. Furthermore, by essentially collecting the gases in front region 120, and redistributing them into proximal region 130, a pressure gradient is formed along the length of the barrel and over time during a fire. The significance of this will be addressed below.

Both of the above described advantages are realized in large part by the fact that there are no surfaces in place between the front region 120 and proximal region 130 which would in turn deflect gases forward, or distally, after they are deflected proximally. Also contributing to this advantage is the fact that a sufficiently large front region exists to allow a pressure build-up within the shroud front region which allows a pressure gradient along the longitudinal position as one moves from the inside of front wall 150 toward the shooter. Then, as the gas travels rearward (proximally) it escapes through circumferential holes 160.

The progressive pressure drop as one moves rearward over time during a firing event achieves several purposes. First, it creates an air flow from inside the barrel (the bore), out the muzzle, rearward over the outside of the barrel, and out the holes. As described below, this air flow can cool the barrel as it moves ambient air that has a lower temperature than the exposed surface of the barrel unit over these surfaces. Essentially, this forced air flow carries heat absorbed in the barrel wall from the bore side, out through the holes. Moreover, there is a convective heat transfer occurring within the system to cool the barrel during a firing sequence.

The redirection of gases exiting the muzzle back over the outer surface of the barrel, depending on the particular embodiment, can either heat the barrel or cool it, depending upon the design constraints. If the special volume inside the barrel is sufficiently large and the barrel is designed to enable the ambient air to move into and out of the space quite readily, then the temperature of the air in this space will generally be less than that of the outer surface area of the barrel, and the effect will be to cool the barrel.

In an embodiment where the internal volume of the shroud is large enough, the amount of ambient air inside the shroud is sufficient such that when mixed with the hot gases exiting the muzzle, the overall temperature of the air mixture drops significantly as compared to that of the bore of the barrel and that of the exposed barrel surfaces. In addition, a porous shroud embodiment that does not inhibit the free flow of ambient air allows for the movement of hot air out, and cooler air into this airspace between firings, helping to keep the ambient air inside the barrel significantly cooler than the exposed surfaces of the barrel with which the air contacts. These two conditions are not found in a typical sound suppressor, which acts to use the gases exiting the muzzle to heat up the barrel. The internal special volume is small, and the suppressor is designed to eliminate the free flow movement of ambient air. This results in the hot gases being trapped in an area in contact with additional surface area of the barrel, and the gases being as hot or hotter than the surfaces they contact.

For sustained fully automatic firing, the time between shots is reduced so much that the cooling effect between shots is reduced, and the temperature of the air inside the barrel approaches that of the internal bore. In such a situation, the movement of the hot gases over the external surfaces of the barrel will heat the barrel as opposed to cool it. In these situations, it helps to incorporate additional design features to minimize the heating affect of the hot gases. Two such design alterations are a firewall located approximately half way down the length of the barrel, and/or the addition of an insulating coating. Both design enhancements are discussed further, below.

Furthermore, the shroud, front wall, and holes combine to improve another aspect of the firearm, namely sound reduction. It is the high pressure gases being first released into the atmosphere that cause the loudness of the muzzle report. A conventional muzzle break redirects gases that would have traveled away from the shooter and projects them perpendicular to the bore or even somewhat rearward in a direction generally toward the shooter. This increases both sound to the shooter's ear, and increases the chances of sending debris and unburned powder and/or powder residue into the shooter's face.

Figure 4:
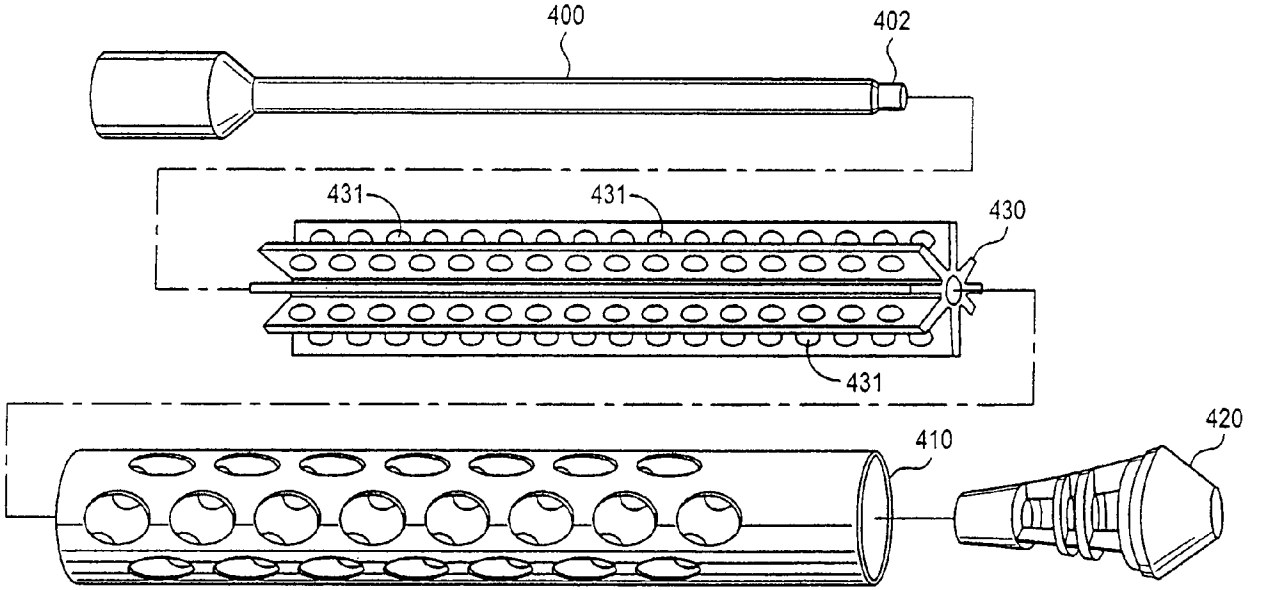
FIG. 4 is an illustration of exemplary components of a preferred embodiment of the assembly of the present invention.

FIG. 4 shows another embodiment of the assembly of the present invention, namely a multi-part gun barrel assembly embodiment having essentially four parts: barrel 400, shroud 410, muzzle cap 420, and optionally fin element 430. It should be noted that barrel 400 is representative of a barrel, barrel liner, or barrel extender, which are all variations of bores known to those skilled in the art. For example, a barrel liner could be made of rifled steel, but the rest of the assembly could be made from light or stiffer material such as aluminum, titanium, or some composite material such as a graphite or carbon fiber composite. The significance of the present invention will not be lost on those skilled in the art with respect to any of these barrels or barrel systems. Moreover, it is intended that barrel 400 refer to any of these known barrel systems, as any can be used in accordance with the present invention.

Figure 5:
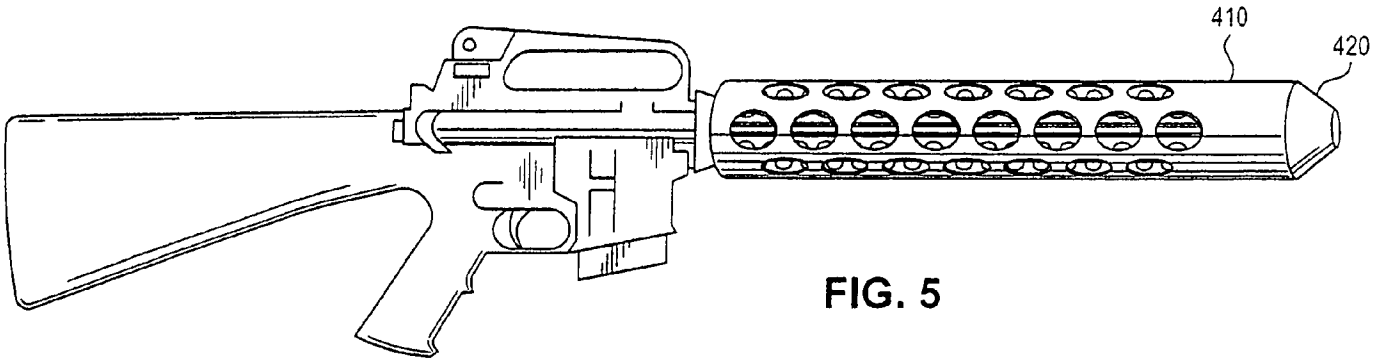
FIG. 5 is an illustration of an exemplary embodiment of the invention disposed on a typical firearm for which the invention is intended.

In the embodiment shown in FIG. 4, barrel 400 would be disposed within shroud 410 and connected to muzzle cap 420 as shown by the connection lines in FIG. 4. A preferred, but by no means exclusive, way of connection is a threaded connection as shown in FIG. 4 with threads 402 shown disposed on the distal end of the barrel 400. Shroud 410 seals up against the proximal portion of muzzle cap 420. The result is to effectively form a seal so that gases expelled from the muzzle end of barrel 400 during firing cannot exit out the front of the cap except for the gas that passes through behind the bullet (as shown schematically in FIG. 3). An alternative embodiment could have the muzzle cap screwed to the shroud. In this later design, the muzzle cap would never need to contact the muzzle (which approaches the design shown above with respect to a one-piece shroud/cap combination as shown in FIGS. 1-3, for example). A completed assembly is shown in conjunction with an otherwise typical M-16 (AR-15 style) rifle in FIG. 5.

Figure 6:
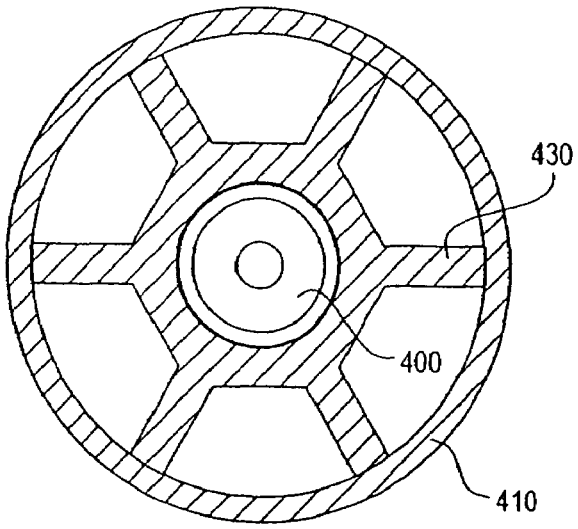
FIG. 6 is a cross sectional view of a barrel, fin element, and shroud in accordance with the present invention.

Also shown in FIG. 4, but optional, is fin element 430. Fin element 430 is comprised of heat-dissipating fins disposed in the annular region which extend longitudinally along, and radially outward from, the gun barrel to the shroud. When utilized, fin element 430 is disposed within the annular space between barrel 400 and shroud 410 and creates pie-shaped channels that run along the barrel out to the shroud. FIG. 6 illustrates a cross sectional view of barrel 400 within fin element 430, all within shroud 410. In the embodiment shown in FIG. 6, there are six fins.

When fin element 430 is used, it is preferred that barrel 400 fit snugly against the inner wall of fin element 430. This will aide in heat transfer from the outer surface of the barrel to the fins and improve cooling of the barrel. A further advantage of a tight fit is that the barrel assembly has increased stiffness which in turn improves accuracy and repeatability, especially during rapid fire. To the extent the barrel is made adequately stiff by utilizing this aspect of the invention, it may be that the need to free float the barrel is obviated. Free-floating a barrel and the concomitant advantages (and disadvantages) of doing so are understood by those skilled in the art.

Figure 7:
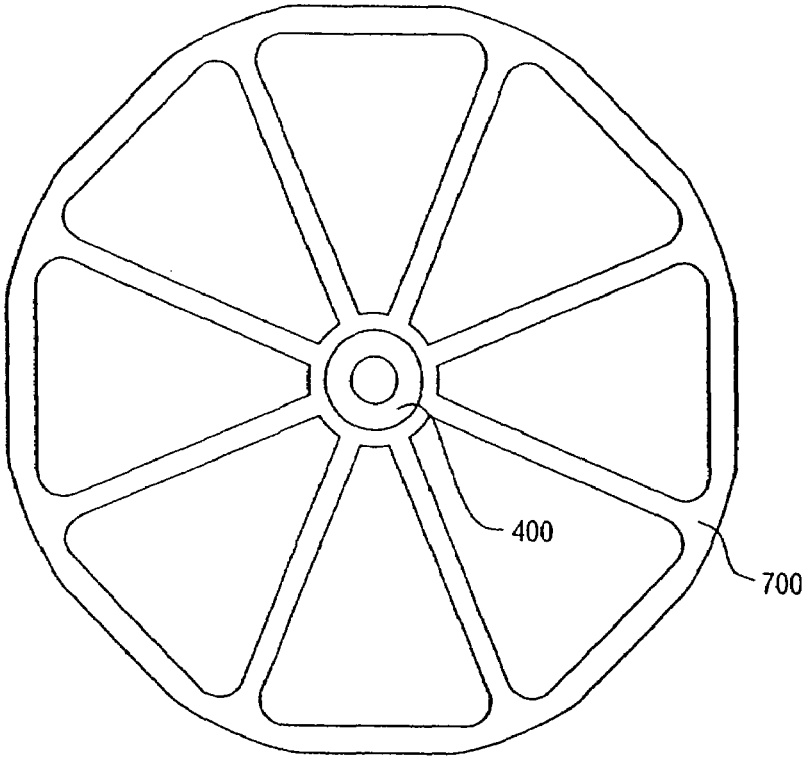
FIG. 7 is a cross sectional view of a one-piece fin element and shroud disposed around a barrel in accordance with the present invention.

Various shapes and designs for the fin element could be envisioned by one skilled in the art with the aide of this disclosure. For example, different shapes, such as that shown in FIG. 7, could be envisioned, and also a unitary fin element/shroud configuration could be utilized (also as shown in FIG. 7). In this embodiment, finned shroud 700 houses barrel 400 within its inner channel. Such one-piece elements can be manufactured in a number of ways, including investment casting, welding, extrusion, or other means.

As seen in FIG. 4, a preferred fin element 430 has holes along each fin to allow passage of gas and/or air from one channel to the next. It is possible, however, to have solid fins defining longitudinal flow channels which are not in fluid communication with their neighboring channels. Air holes 431 allow for better cooling of the barrel and assembly, however, by allowing air and gas currents to flow between channels. It also results in a lower weight of the unit.

Turning again to muzzle cap 420, it is noted that it is important that it divert as much gas as possible from the forward direction as a projectile leaves the muzzle, travels through shroud front region 120, and exits the assembly through hole 140. During this diversion, the diverted gases are directed in a rearward manner as pressure builds within the shroud front region 120. As this happens, the gases expand into the annular region in the shroud proximal region 130. By allowing this initial expansion to occur in a semi-closed space, the initial shock wave of the diverted gases is not initially allowed into the atmosphere, which thus limits sound. The shroud front region is preferably large enough given the particular firearm the assembly is provided to control, that the gases are diverted to a degree such that the gases are given enough space to slow down before entering the surrounding atmosphere such that the sound created from the shot is greatly diminished.

Referring now to FIG. 8, a cross sectional view of an embodiment having barrel 800, muzzle cap 810, and shroud 820 is shown. Shroud 820 has circumferential holes 825 disposed only in its proximal portion 830. During a firing sequence, gases build in the proximal distal portion of the shroud and as pressure builds, gases travel rearward, or proximally, through the annular space and begin to escape out of circumferential holes 825. Some gas continues on toward yet more rearward holes, and so on. By the time the remaining gases in the shroud reach the rear-most holes, most of the pressure has decreased substantially within the system. The pressure gradient thus generated effectuates a controlled release of gases during a fire, and obtains the advantages with respect to sound and felt recoil as noted above.

As noted in FIG. 8, muzzle cap 810 is connected to the distal end of the barrel and creates an open chamber defined by shroud front region 860, the end of the muzzle opening 840, and the rear of front wall 850. As can be seen, this configuration allows for the shroud front region and annular region to be in fluid communication with each other such that there is substantially no obstruction between the shroud front region and the annular region at their interface (defined as a plane shown schematically by line 890 which is actually a plane defined as perpendicular to the longitudinal axis of the bore and the muzzle opening). This is important so that gases traveling rearward during firing are not obstructed as they travel into the shroud's proximal, annular, region.

Figure 10:
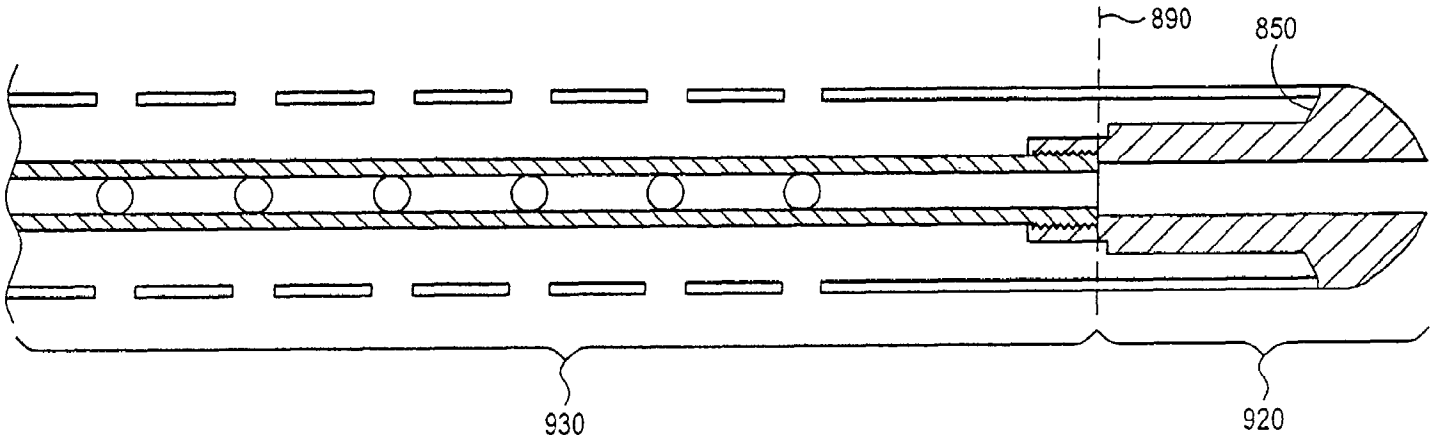
FIG. 10 is a partial cross sectional view of the embodiment shown in FIG. 9 but which ahs been rotated 90°.

As can be seen by viewing FIGS. 9, 9A, and 10, there is no obstruction to gas flowing rearward from the portion of space distal plane 890 to the portion of annular space proximal plane 890. This annular interface can be defined as interface 900 and is shown clearly in FIG. 9A, which is a cross section at the interface. In the embodiment shown in FIGS. 9 and 10, which are representations of partial cross sectional views of the same embodiment rotated 90° from each other, it can be seen that shroud front region 920 and annular region 930 are in fluid communication and have substantially no obstruction between them to obstruct the flow of gas from the former to the later. This is important because any such obstruction would create a rearward force during firing, which would only increase the degree of felt recoil to the operator. The fact that the force-receiving surface is the rear of front wall 850 means that felt recoil is reduced due to a forward momentum being created as gases strike the rear of the front surface, pulling the firearm away from the shooter's body.

Figure 11:
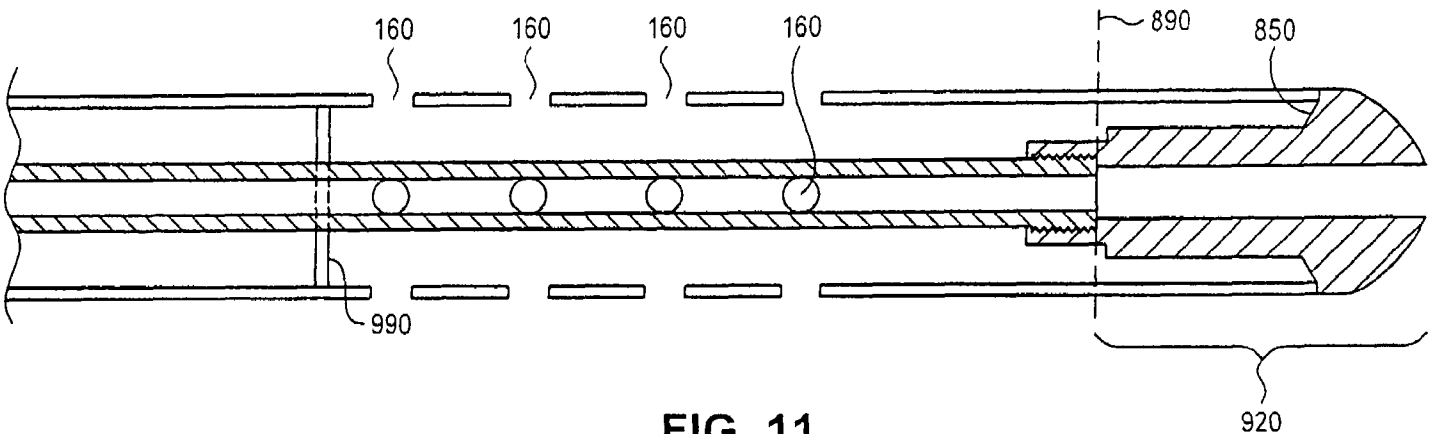
FIG. 11 is a partial cross sectional view of an embodiment of the present invention including a firewall.

Another embodiment, shown schematically in FIG. 11, includes a firewall 990. Preferably, the firewall is comprised of a piece of thin sheet steel. Firewall 990 adds an additional feature to the present invention in that it is disposed somewhere along the annular area behind the muzzle opening. It can be rear of all circumferential holes 160 or disposed with circumferential holes both distal and proximal. The key is that it generally seals the annular area and keep explosive product gases from coming further rearward as compared to the case where no firewall is used. One aspect to this optional addition to the barrel assembly of the present invention relates to barrel cooling. As discussed above, during a firing sequence, the hot expanding gases travel down the muzzle and can heat the barrel wall. To the extent they are then redirected over the outside of the barrel in accordance with the rearward redirection of gases in accordance with the invention, there is some secondary, additional heat transfer back into the outside of the barrel wall during the backward flow, which, under certain circumstances, may offset. It may be desirous in these certain applications to limit the amount of secondary exposure of the barrel to these hot gases. In such applications, a firewall can be used to prevent or limit the secondary exposure to some portions of the barrel, most notably the breech end of the barrel where cooling is most important in terms of prolonged barrel life.

In this same regard, an additional feature to the firewall would be to prevent expulsion of gases in the rearward (or proximal) portion of the shroud such that the shooter's hands, or the firearms sighting instruments (e.g., scope or laser) would be detrimentally impacted.

In still yet another embodiment of a device using a firewall, it could be that circumferential holes exist in the shroud all the way to the rear (proximal) portion of the shroud, even rearward of the firewall placement, simply to achieve a weight reduction in the assembly, yet still achieve the advantages described above with respect to control of gas expulsion.

In still yet another embodiment, the firewall described above may be un-fixed. It could be moveable within the assembly so that it can move between a forward position and rearward position. In such a case, the firewall would be disposed within the annular region between the barrel and shroud with a biasing means to bias it to a forward at-rest position. A spring, gas cylinder, or other appropriate means would be suitable.

Figure 12:
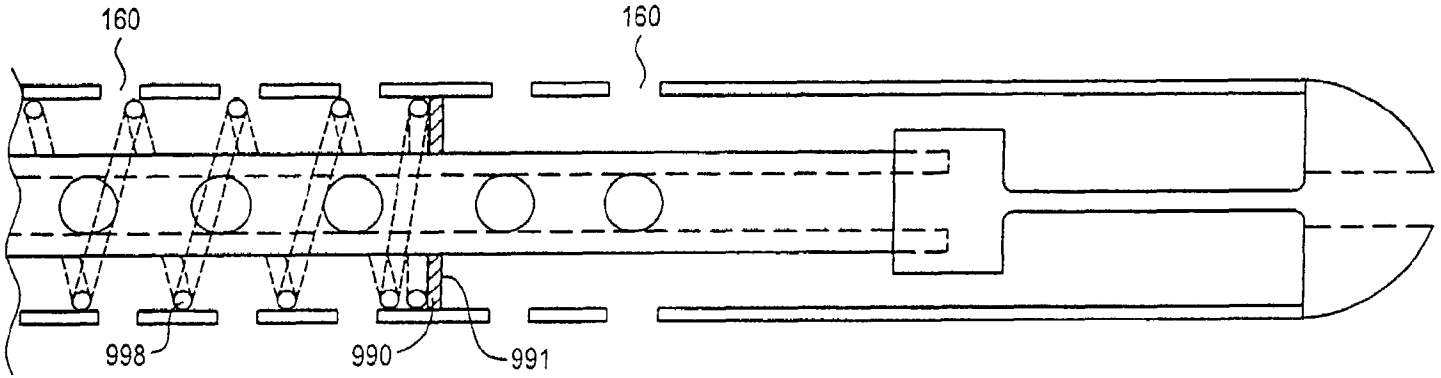
FIG. 12 is a partial cross sectional view of an embodiment of the present invention including a moveable firewall.

FIG. 12 shows an exemplary embodiment with biasing means in the form of a spring, namely coil spring 998. In such an embodiment, as gases move rearward during a fire, they contact the front wall 991 of firewall 990 and move it rearward loading spring 998. This event causes essentially two important things to happen. First, air that is in the annular space behind firewall 990 is pushed out circumferential holes 160 which are behind firewall 990 at any given point during the movement. As hot gases move firewall 990 rearward and pass radially outward through circumferential holes 160 that are in front of firewall 990 during the firewall movement, the pressure reduces, and eventually firewall 990 stops moving rearward (because in this embodiment spring 998 becomes increasingly harder to compress as it is loaded, or in an alternate design, there could be a hardstop component that physically limits the range of rearward motion.). At some point, firewall 990 stops moving rearward, and starts moving forward again. This is the second important part. As firewall 990 moves forward again, it pushes the remaining hot air in front of it out through those circumferential holes 160 which are in front of it, and correspondingly draws fresh air in behind it through circumferential holes 160 as firewall 990 moves forward to its at rest position. All of this forced air movement improves cooling of the barrel. This method of cooling is especially beneficial in that only ambient air is moved over the critical breach end of the barrel. Preferably, the bias is a spring, and more preferably includes a guide rod (much like that of a model M1911) that cycles with every discharge of gas.

In an additional embodiment which combines the firewall concept with the fin element aspect discussed above, the firewall would actually be a series of wall sections, each with the shape of the individual channels defined by the fins. As noted above, FIGS. 6 and 7 show cross sectional views of two embodiments with differing fin element/shroud configurations forming differing channel shapes. In these cases, each opening would be closed off with a suitably shaped firewall. In the case of a non-moving firewall, each of the pieces is attached to the outer shroud and respective edges of the fin element to close off the flow of gas beyond the firewall.

Figure 13:
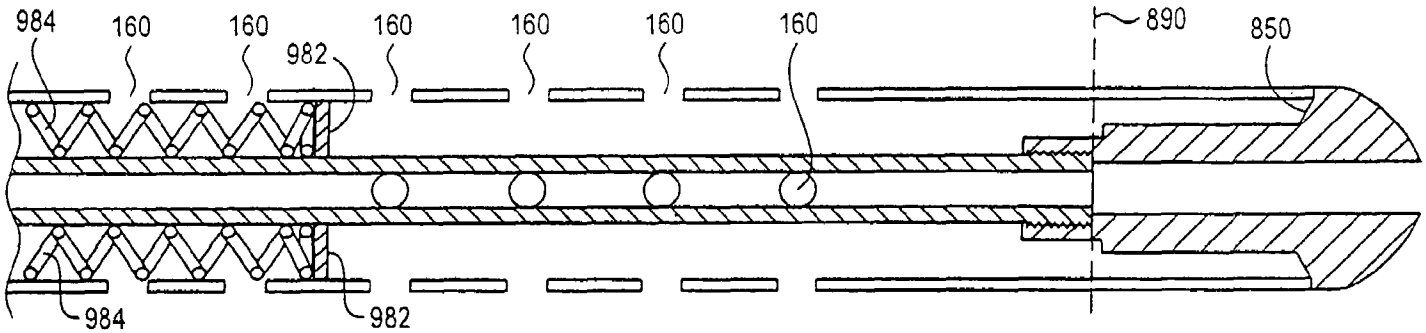
FIG. 13 is a partial cross sectional view of an embodiment of the present invention having at least two firewall pieces, each moveable and each disposed within a channel defined by the fin element.

For the moving firewall embodiment, each piece fits closely to generally seal out the gases but is free to move rearward and then forward. As noted above with respect to the one-piece firewall embodiment, the cyclic action of the firewall pieces causes the air in the rear section to be expelled through proximal circumferential holes and new air to be pulled back in through those same holes with every cycle, without allowing any of the hot gases to make it past the moving firewall barrier. In the case of multiple pieces of firewall, each disposed within its own channel, each piece would also need its own biasing means. FIG. 13 shows such an embodiment where each channel has a firewall piece, each biased by its own spring. In FIG. 13, although only two are shown in cross section, each firewall piece 982 has its respective spring 984 biasing it forward to its at-rest position. Also shown in FIG. 13 is the embodiment where circumferential holes 160 exist both forward and rearward of the firewall pieces.

It is also a part of the present invention that some of the firewall pieces could be stationary, and some moveable, such as for example every other piece as one moves around the axis.

Figure 14:
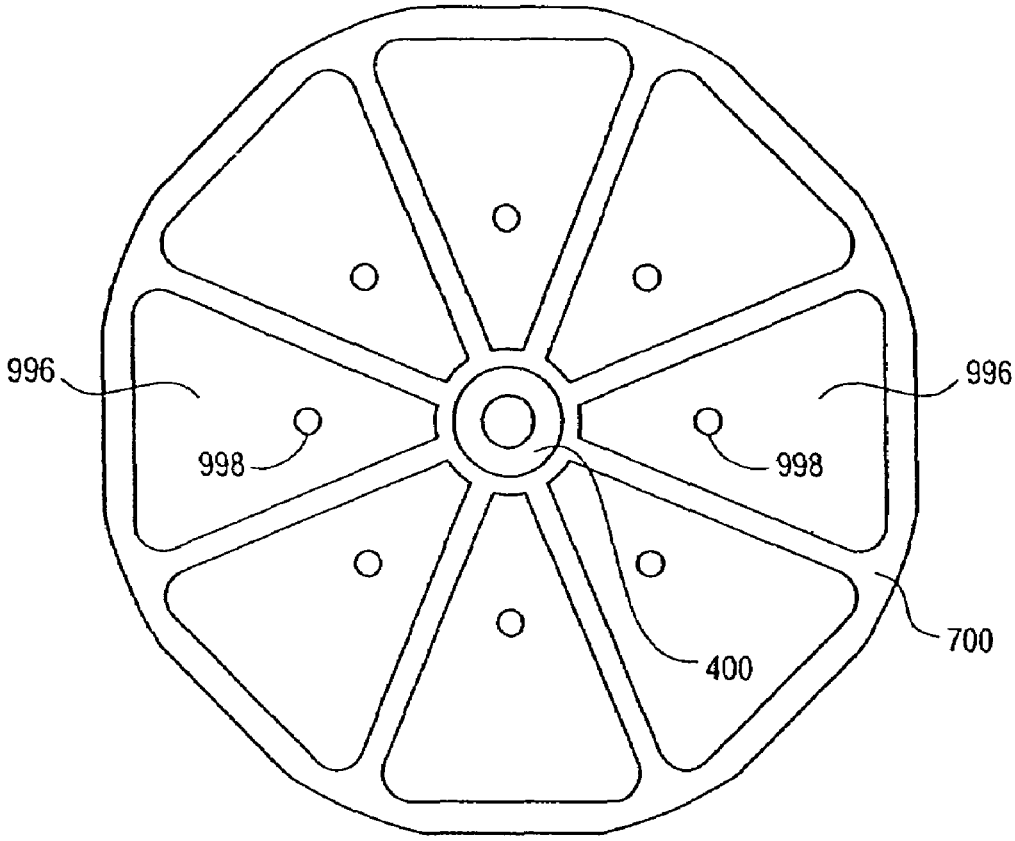
FIG. 14 is a partial cross sectional view of an octagonal shroud with an 8-fin fin element and a firewall piece disposed in each channel, with each firewall piece having a hole disposed therein.

It would also be possible to control gas expulsion through the firewall with small or limited holes in the firewall or firewall pieces themselves. Such an embodiment is shown in FIG. 14. Here, each firewall piece 996 has a small hole 998. It is noted that it would be possible to have a small hole only in select, or some, of the sections of the firewall to allow a very small amount of gas to move into the rear section to help move the air, but not so much as to heat up the rear of the barrel or shroud in the rearward annular space.

Another aspect of this forced air movement is that it can be used to channel the pressurized air into a cycling action for fully auto or semi-auto applications, or to gain other mechanical advantages through the compression and expansion cycles caused during a firing sequence. In this situation, the rearward movement of the firewall can itself cycle the action, relying on the force exerted on the firewall to drive the action fully rearward to eject the spent case and put it in a position to cycle forward and rechamber a fresh round. Alternatively, the rearward movement of the firewall can be used to unlock the action and allow the forces acting on the boltface to cycle the action.

Still yet another aspect of the present invention could include applying an insulating coating to the inside of the shroud to reduce heat transfer to the shroud. The coating could be applied on all surfaces inside the shroud. More likely, the coating would be applied to only those surfaces inside the shroud that are forward of the firewall, when used in conjunction with a firewall. In such an arrangement, the hot gases would have less impact on heating the barrel forward of the firewall while still enabling the uncoated surface rear of the firewall to dissipate heat to the ambient air.

The insulating coating need not be used solely in conjunction with the firewall. In a design without a firewall, the coating may still be applied to surfaces inside the shroud that are in the forward section of the barrel, where the gases are hottest because they have mixed with a minimal amount of ambient air. For example, in FIG. 10, the coating may only be applied to surfaces that are forward of line 890. Alternately, they may be applied as far back as the first exit holes in the shroud, or even a bit further back still.

Further still, the insulating coating can be applied to all internal surfaces of the barrel. In such a case, radiant and conduction cooling would be limited to the surface on the outside of the barrel shroud and the ribs would act only to conduct the heat to these surfaces.

Although the present invention has been particularly described in conjunction with specific preferred embodiments, it is evident that many alternatives, modifications, and variations will be apparent to those skilled in the art. It is therefore contemplated that the appended claims will embrace any such alternatives, modifications, and variations as falling within the true scope and spirit of the present invention.

What is claimed:

1. A gun barrel assembly comprising:

a gun barrel having a muzzle opening on a distal end;

a shroud coaxially surrounding at least a portion of the barrel, the shroud having:

a distal portion extending beyond the muzzle opening defining a shroud front region having a distal end portion, a proximal portion extending proximally from the muzzle opening defining an annular region between the barrel and shroud, a front wall disposed at the distal end portion of the shroud, the front wall having an opening to allow passage of a projectile fired from the firearm, and circumferential holes in the proximal portion of the shroud; and a moveable firewall disposed in the annular region of the proximal portion of the shroud, the firewall moveable between a forward, at-rest position, and a rearward, compressed position; whereby gases generated during fire compress the firewall rearward forcing air out of the annular region proximal to the firewall and allowing expanding gases generated during fire to escape out of the circumferential holes distal to the firewall.

2. The gun barrel assembly of claim 1 further comprising heat-dissipating fins in the annular region of the shroud, the fins extending radially outward from the gun barrel to the shroud.

3. The gun barrel assembly of claim 1 further comprising means for biasing the moveable firewall forward to its at-rest position.

4. The gun barrel assembly of claim 1 further comprising a spring for biasing the moveable firewall forward to its at-rest position.

5. The gun barrel assembly of claim 1 further comprising a cylinder for biasing the moveable firewall forward to its at-rest position.

6. The gun barrel assembly of claim 1 further comprising heat-dissipating fins in the annular region extending longitudinally along, and radially outward from, the gun barrel to the shroud, the fins defining channels; said firewall disposed in at least one of the channels.

7. The gun barrel assembly of claim 1 wherein the firewall has at least one hole disposed therein to allow partial passage of gas therethrough.

* * * * *

UNITED STATES PATENT AND TRADEMARK OFFICE

CERTIFICATE OF CORRECTION

PATENT NO. : 7,707,763 B2
APPLICATION NO. : 11/888778
DATED : May 4, 2010
INVENTOR(S) : John Brixius It is certified that error appears in the above-identified patent and that said Letters Patent is hereby corrected as shown below:

Col. 11, line 8, Claim 1 should read:

A gun barrel assembly comprising: a gun barrel having a muzzle opening on a distal end; a shroud coaxially surrounding at least a portion of the barrel, the shroud having: a distal portion extending beyond the muzzle opening defining a shroud front region having a distal end portion, a proximal portion extending proximally from the muzzle opening defining an annular region between the barrel and shroud, a front wall disposed at the distal end portion of the shroud, the front wall having an opening to allow passage of a projectile fired from the gun barrel, and circumferential holes in the proximal portion of the shroud; and a firewall moveable relative to the gun barrel disposed in the annular region of the proximal portion of the shroud, the firewall moveable relative to the gun barrel between a forward, at-rest position, and a rearward, compressed position; whereby gases generated during fire compress the firewall rearward forcing air out of the annular region proximal to the firewall via at least one of the circumferential holes, and allowing expanding gases generated during fire to escape out of the annular region distal to the firewall via at least one other of the circumferential holes.

Signed and Sealed this

Sixteenth Day of November, 2010

David J. Kappos

David J. Kappos
*Director of the United States Patent and Trademark Office*